US007317810B2

(12) United States Patent
Ohashi

(10) Patent No.: US 7,317,810 B2
(45) Date of Patent: Jan. 8, 2008

(54) MAGNETIC CIRCUIT AND SPEAKER

(75) Inventor: Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 374 days.

(21) Appl. No.: 11/020,292

(22) Filed: Dec. 27, 2004

(65) Prior Publication Data

US 2005/0163338 A1 Jul. 28, 2005

(30) Foreign Application Priority Data

Jan. 6, 2004 (JP) ..... 2004-001323

(51) Int. Cl.
*H04R 1/02* (2006.01)
*H04R 11/02* (2006.01)

(52) U.S. Cl. ..... 381/421; 381/186

(58) Field of Classification Search ..... 381/182, 381/186, 412, 421, 423, 430; 335/302, 306
See application file for complete search history.

(56) References Cited

FOREIGN PATENT DOCUMENTS

GB EP0613322 A2 * 8/1994

* cited by examiner

*Primary Examiner*—Brian Ensey
(74) *Attorney, Agent, or Firm*—Oblon, Spivak, McClelland, Maier & Neustadt, P.C.

(57) ABSTRACT

A speaker and a magnetic circuit for a speaker, in which the high quality sound is obtained, are provided using a structure which is thin, light-weight and symmetrical in the vibration direction. In three sheets of layered magnets, the first magnet of the first layer and the third magnet of the third layer are arranged in the magnetic directions which repel each other, and the polarity of second magnet of the second layer is arranged perpendicularly to the polarity of the first and third magnets of the first and third layers at the top and bottom thereof. A voice coil wound near the center of a voice coil bobbin is arranged to oppose the second magnet of the second layer of the magnetic circuit composed of the three layers, and the same vibration systems composed of the diaphragms and edges are connected to both the ends of this voice coil bobbin. Accordingly, the speaker which has a vibration system that is symmetrical with respect to a center axis X-X perpendicular to the direction of a center axis of a voice coil is obtained.

3 Claims, 4 Drawing Sheets

MAGNETIC CIRCUIT AND SPEAKER

BACKGROUND OF THE INVENTION

1. Field of the Invention

The present invention relates to a magnetic circuit and a speaker and particularly relates to a magnetic circuit which includes only a magnet without a yoke, which is thin and light in weight and which has a symmetrical structure with respect to the vibration direction, and to the improvement of a speaker using this magnetic circuit.

2. Description of the Related Art

Conventionally, as a thin type speaker or magnetic circuit for a speaker, it is known one disclosed in patent literature 1 in which thin disk-shaped or ring-shaped two sheets of magnets with the same polarity of S, S (N, N) are arranged opposing each other with a spacer made of a non-magnetic material positioned in between.

FIG. 1 shows a vertically sectional view of a speaker disclosed in Japan Published Utility Model Application No. H2-30957, in which the magnetic circuit includes: first and second ring-shaped magnets 1 and 1 magnetized in the direction of upper and lower surfaces and disposed whose magnetized surfaces of the same polarity such as S, S (N, N) oppose each other with a spacer 6 made of a non-magnetic disk-shaped material in between, and a bobbin hangs down from a diaphragm 5 to the outer circumference of the spacer 6, around which a voice coil 3 is wound. Further, at approximately the center position of the spacer 6 a third and a fourth disk-shaped magnets 1*a* and 1*a* formed of the same small magnetic circuit as described above through a cylindrical shaped spacer are magnetized in the direction of the upper and lower surfaces and are disposed whose magnetized surfaces of the same polarity such as S, S (N, N) oppose each other with a spacer 6*a* made of a non-magnetic disk-shaped material in between, and a bobbin hangs down from a diaphragm 5*a* to the outer circumference of the spacer 6*a*, around which a voice coil 3*a* is wound to form a coaxial type speaker. A vibration system including the diaphragms 5, 5*a* and the edges 4, 4*a* is held by a frame 7.

Further, a speaker is disclosed in Japan Published Patent Application No. H6-233384, in which a repulsion magnetic field is formed by arranging two sheets of magnets in the magnetic directions which repel each other; the voice coil wound approximately around the center of the outer circumference of a voice coil bobbin is disposed in this repulsion magnetic field; the inner circumference portion of a diaphragm is connected to the center of the outer circumference of this voice coil; also both the end portions of the outer circumference of the above voice coil bobbin are supported by two sheets of dumpers which are disposed at an interval to each other; and a support system of this voice coil is formed in a symmetrical-shape with a center axis perpendicular to the direction of an axis of the voice coil to be an axis of symmetry.

FIG. 2 is a schematic diagram showing a winding method of the voice coil in the vicinity of a magnetic circuit in the speaker disclosed in Japan Published Patent Application No. H6-233384, and the repulsion magnetic field is formed by arranging two sheets of magnets 1*b*, 1*b* in the magnetic directions which repel each other with a spacer 6 in between. In such a magnetic circuit, a strong magnetic field is generated in a portion of the leakage magnetic flux Φ1 between the magnets 1*b* and 1*b*, and a magnetic field in the reverse direction is generated in the portions of each leakage magnetic flux of Φ2 and Φ3 around the magnets 1*b* and 1*b*.

Then, as shown in FIG. 2, the voice coil 3 is formed by arranging a first coil 3*a* wound at the position approximately corresponding to one magnet 1*b*, a second coil 3*b* wound at the position approximately corresponding to the spacer 6 and a third coil 3*c* wound at the position approximately corresponding to the other magnet 1*b* in the outer circumference of a voice coil bobbin 8 in a row. Further, as shown with an arrow in FIG. 2, the winding direction of the first and third coils 3*a* and 3*c* is a reverse direction to the winding direction of the second coil 3*b*.

By arranging the voice coil 3 in the repulsion magnetic field formed by the magnets 1*b* and 1*b* and the spacer 6, a driving force can be obtained from the second coil 3*b* in the leakage magnetic flux Φ1 portion generating a strong magnetic field, and a driving force can be obtained by the first and third coils 3*a* and 3*c* from each leakage magnetic flux portion of Φ2 and Φ3 generating a magnetic field of a reverse direction. Therefore, there are disclosed that with the portion constituting the magnetic circuit being thinner and lighter in weight, a large driving force can be obtained, and a constant impedance characteristic can be obtained by the inductance reduction effect mutually generated in the coils, so that a high frequency region can be improved efficiently.

However, each of the above described conventional art has a structure in which a magnetic circuit including the magnets 1, 1*a* and 1*b*, and the spacer 6 made of a non-magnetic or ferromagnetic material are arranged on the inner side of the voice coil bobbin 8. Therefore, a structure to support a magnetic circuit is necessary, and a speaker which has a symmetrical vibration system with respect to a center axis that is perpendicular to the direction of a center axis of the voice coil 3 can not be obtained. As a result, there is no symmetry in the vibration direction of the diaphragms 5 and 5*a*, which causes the distortion of acoustic signals.

In order to obtain a vibration system that is symmetrical with respect to the vibration direction, it is considered to form a magnetic circuit of a inside magnetic type in which the voice coil is arranged inside the frame-shaped or ring-shaped magnetic circuit formed of the frame-shaped or ring-shaped two sheets of magnets 1, 1*a*, 1*b* making the same polarity opposing each other with a spacer made of a frame-shaped or ring-shaped non-magnetic or ferromagnetic material in between.

In a speaker of such magnetic circuit construction, it is possible to obtain a speaker having a symmetrical structure in the vibration direction by supporting the outer circumference portion of a frame-shaped or ring-shaped magnetic circuit from the outside.

However, in a frame-shaped or ring-shaped magnetic circuit, magnetic flux converges in the outer circumference of a frame-shaped or ring-shaped magnetic circuit, and this magnetic flux becomes useless because it does not contribute at all to drive a speaker.

Further, in such magnetic circuit, when using a spacer 6 made of non-magnetic material, the magnetic energy (effective magnetic flux) which the magnets 1, 1*a* and 1*b* have can not be taken out efficiently.

Furthermore, though the magnetic energy can be taken out efficiently when using a spacer 6 made of a ferromagnetic material, the magnetic flux density of the spacer 6 made of a ferromagnetic material is saturated when a magnet having a large magnetic energy is used, resulting in difficulty in which an effective magnetic flux cannot be taken out efficiently.

The present invention has been made in order to solve the above described problems, and the purpose of the present invention is to obtain a speaker which is thin and light in weight and which has a symmetrical vibration system with respect to a center axis which is perpendicular to the direction of the center axis of the voice coil, and to provide accordingly a speaker which can obtain the high quality sound.

Another purpose of the present invention is to improve the rate of use for a magnet by efficiently using a strong leakage flux in a thin and light-weight magnetic circuit whose magnetic path is not closed, and to provide a magnetic circuit without a saturation phenomenon of the magnetic flux caused by components (spacer, plate, yoke and so on) which constitute a magnetic circuit.

Further another purpose of the present invention is to provide a magnetic circuit and speaker in which a plurality of coils are combined to reduce the inductance component of the input impedance of the voice coil, so that the amplitude of vibration of a constant input impedance speaker and a diaphragm is expanded.

SUMMARY OF THE INVENTION

A first aspect of the present invention is a magnetic circuit including at least three layered magnets, in which a first magnet of a first layer and a third magnet of a third layer are arranged in the magnetic directions which repel each other, and a second magnet of a second layer, whose direction of polarity is perpendicular to the direction of polarity of the first magnet of the first layer and the third magnet of the third layer, is arranged.

The second aspect of the present invention is a speaker including a magnetic circuit which has at least three layered magnets, in which the first magnet of the first layer and the third magnet of the third layer are arranged in the magnetic directions which repel each other, and the second magnet of the second layer, whose direction of polarity is perpendicular to the direction of polarity of the first magnet of the first layer and third magnet of the third layer, is arranged.

The third aspect of the present invention is a speaker in which each of the first through third magnets constituting a magnetic circuit is ring-shaped or has the shape of a polygonal frame and a voice coil with or without a bobbin wound around is arranged to oppose the second magnet of the second layer.

The fourth aspect of the present invention is a speaker in which the winding direction of the second voice coil wound around a bobbin to oppose the second magnet of the second layer is the inverse direction to that of the first voice coil and third voice coil wound around the bobbin to oppose the first magnet of the first layer and third magnet of the third layer.

According to the magnetic circuit and speaker of the first and second aspects of the present invention, in the three layered sheets of magnets, the first magnet of the first layer and the third magnet of the third layer are arranged in the magnetic directions which repel each other, and the second magnet of the second layer is arranged whose direction of polarity is perpendicular to that of the first magnet of the first layer and third magnet of the third layer located on top and bottom thereof, so that the magnetic flux can be made to converge on the polarity end on one side of the second magnet of the second layer. In the first and third magnets of the first and third layer, the portion at which this magnetic flux is converged is the polarity of the end surface which is not in contact with the second layer, in other words, it is at the end of polarity which is opposite to the top side and bottom side (polarities of magnets are the same) of a magnetic circuit including three layers. In this way, a large magnetic field can be obtained by converging the magnetic flux which comes from the first, second and third magnets constituting three layers at the one portion. Furthermore, since a ferromagnetic substance which has the saturation magnetic flux density characteristic represented by iron material is not used, a large magnetic field in proportion to the magnetic energy of the first, second and third magnets which are used can be obtained in the region where the magnetic flux density is saturated.

According to a speaker of the third aspect of the present invention, a voice coil wound around a voice coil bobbin is arranged to oppose the second magnet of the second layer inside a ring-shaped or polygonal frame-shaped magnetic circuit including three layers and the approximately the same vibration system which is composed of a diaphragm and an edge are connected to both the ends of a voice coil bobbin, so that a speaker which has the vibration system symmetrical with respect to a center axis perpendicular to the direction of a center axis of the voice coil can be obtained.

According to a speaker of the fourth aspect of the present invention, the winding direction of the voice coil wound around a bobbin to oppose the second magnet of the second layer is the reverse direction to the winding direction of voice coils wound around a bobbin to oppose to the first magnet of the first layer and third magnet of the third layer to be connected in series, so that a speaker which has a small inductance component of the input impedance can be obtained. Further, since a voice coil is formed with the winding directions of the first and third voice coils opposite, the direction of a driving force from the second magnet of the second layer which the voice coil opposes, and the direction of a driving force from the first and third voice coils which oppose the first and third magnets of the first and third layers in which the magnetic flux has an opposite direction to the second magnet of the second layer become the same direction, so that a sufficient driving force can be obtained though the speaker is thin and light in weight.

In the present invention, since the polarities of the three sheets of magnets are used to form a magnetic circuit, a speaker and magnetic circuit which are extremely thin and light in weight can be obtained.

Further, since a voice coil is wound approximately in the center of the outer circumference of a voice coil bobbin and a symmetrical vibration system is connected to both the ends of this voice coil, a speaker and magnetic circuit of high sound quality can be obtained.

Furthermore, the first, second and third coils are wound around a voice coil bobbin at the positions which oppose respective magnets, and the winding direction of the first and third coils wound at the positions opposing the first and third magnets of the first layer and third layer is reverse to the winding direction of the second coil wound at the position opposing the second magnet of the second layer to form a voice coil, and therefore the second coil obtains a driving force from the second magnet of the second layer, and the first and third coils obtain a driving force from the portion around the first and third magnets of the first and third layers where the magnetic field of the reverse direction occurs, so that a magnetic circuit and a speaker of light-weight and thin-shaped, nevertheless, with a sufficient driving force can be obtained.

Moreover, the inductance component of the input impedance of a speaker is made to decrease, the high frequency characteristic is improved, and a ferromagnetic substance which has the magnetic flux density saturation characteristic is not used as a part of the magnetic circuit, so that a magnetic circuit and speaker can be obtained in which the saturation phenomenon of the magnetic flux density does not occur even if a magnet having a considerably large magnetic energy is used.

DESCRIPTION OF THE PREFERRED EMBODIMENTS

Figure 2:
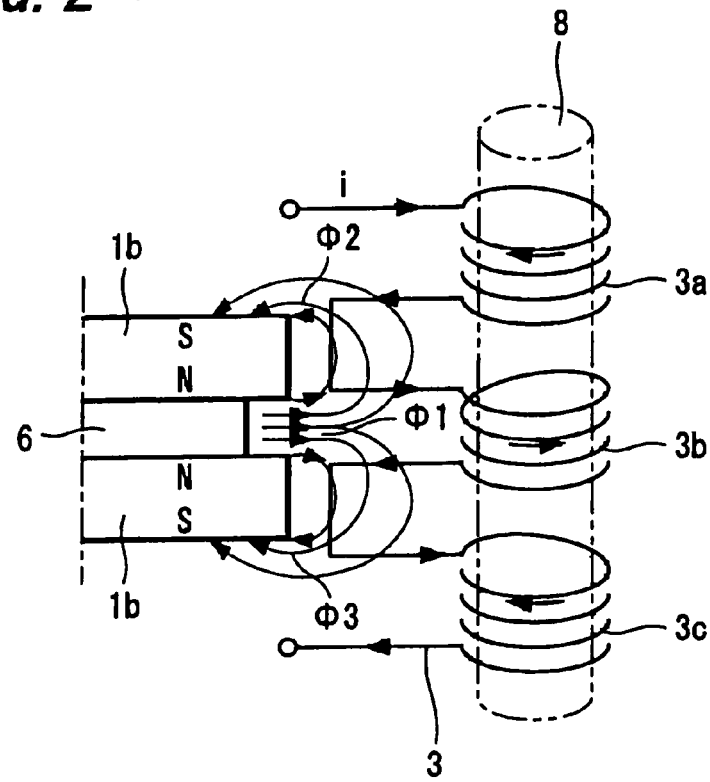
FIG. 2 (RELATED ART)
FIG. 2 is a schematic diagram showing a winding method of a voice coil in the vicinity of a magnetic circuit of a conventional speaker.
Figure 3:
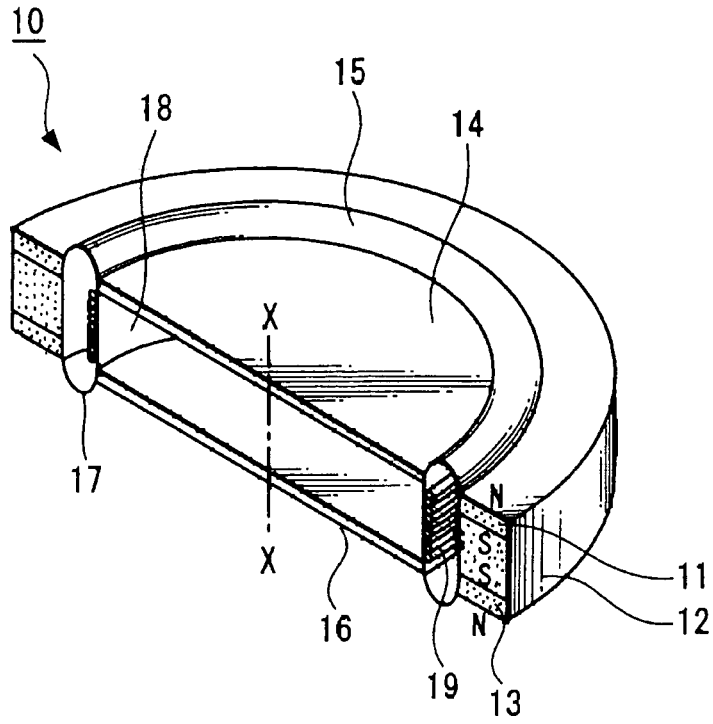
FIG. 3 is a partly sectional and perspective view of a speaker according to an embodiment of the present invention.
Figure 4:
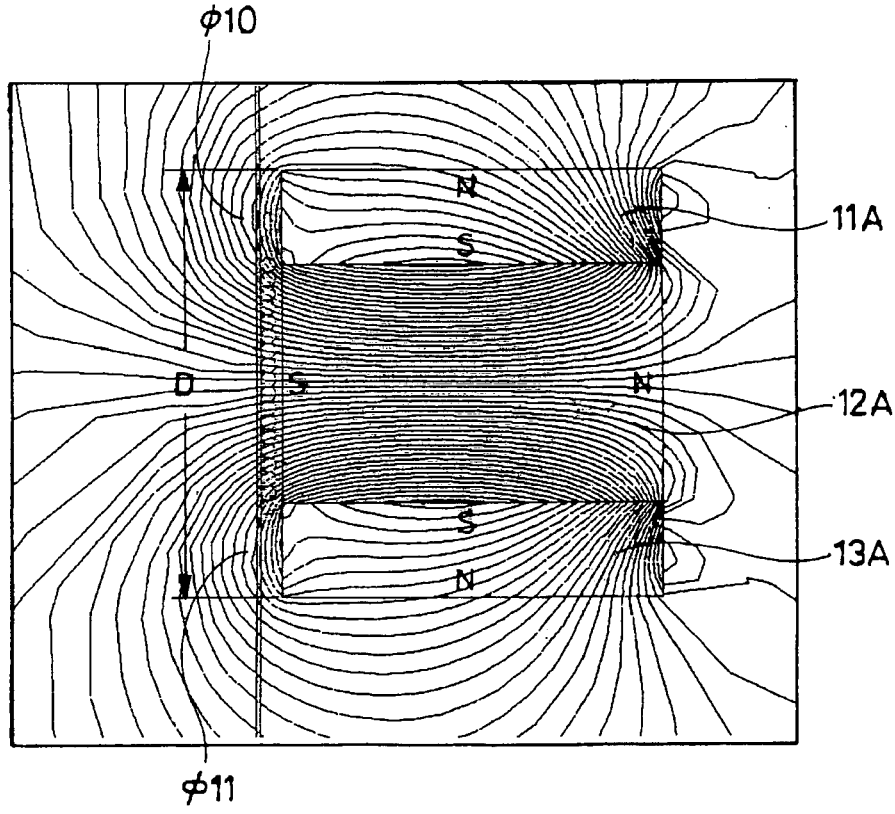
FIG. 4 is a magnetic-flux distribution map of a magnetic circuit shown in FIG. 3.
Figure 5:
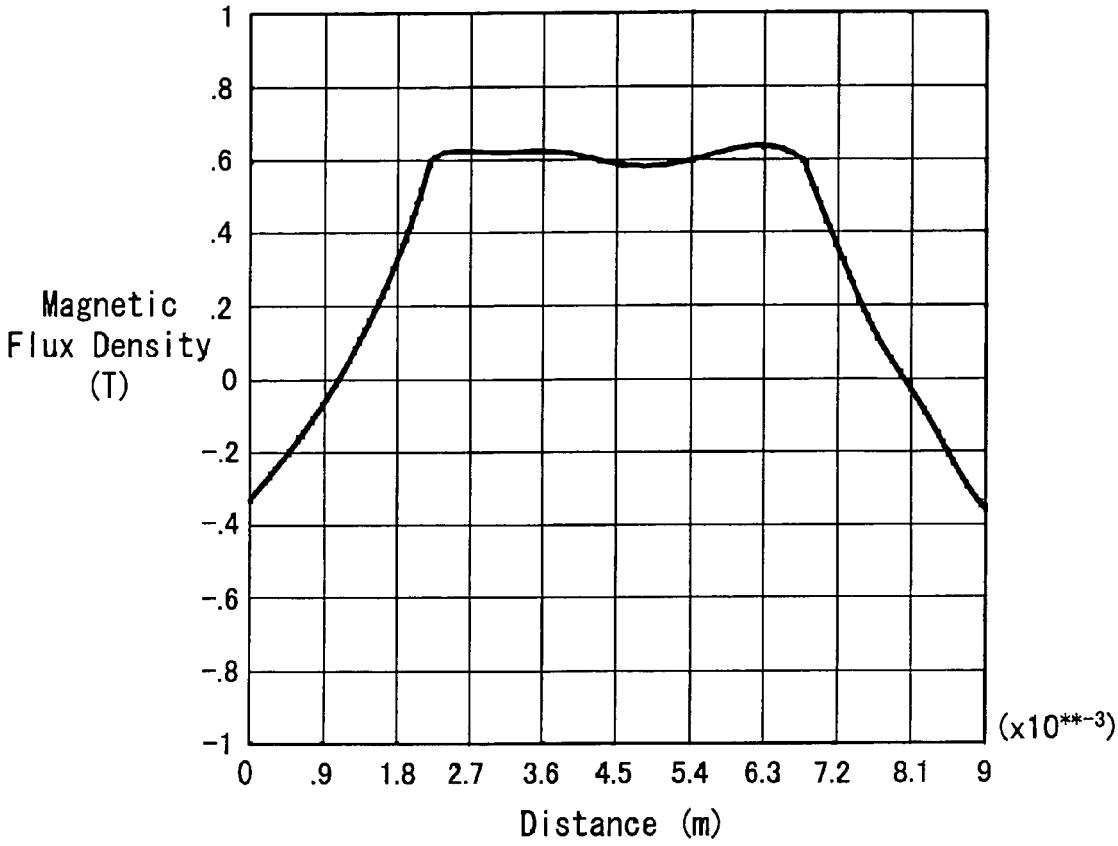
FIG. 5 is a graph showing a calculation result of the magnetic-flux distribution of a magnetic circuit and speaker according to an embodiment of the present invention.
Figure 6:
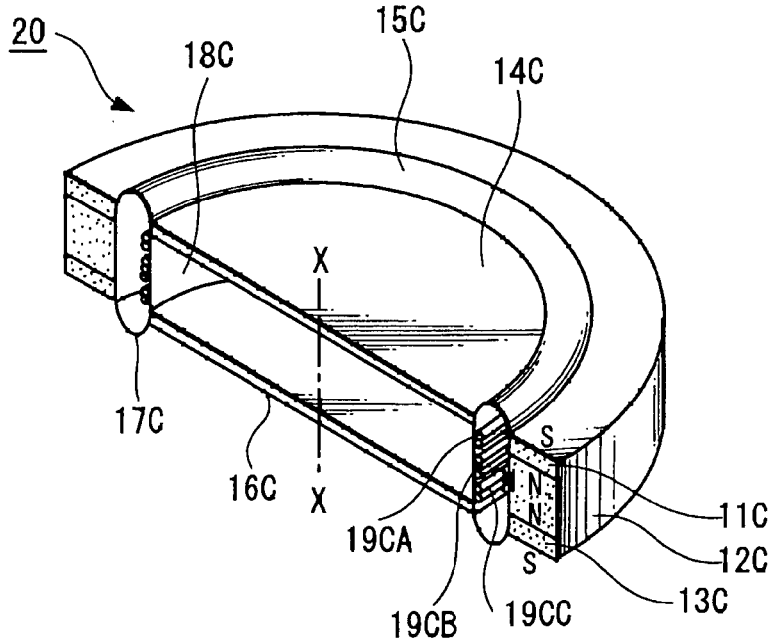
FIG. 6 is a partly sectional and perspective view of a speaker according to another embodiment of the present invention.
Figure 7:
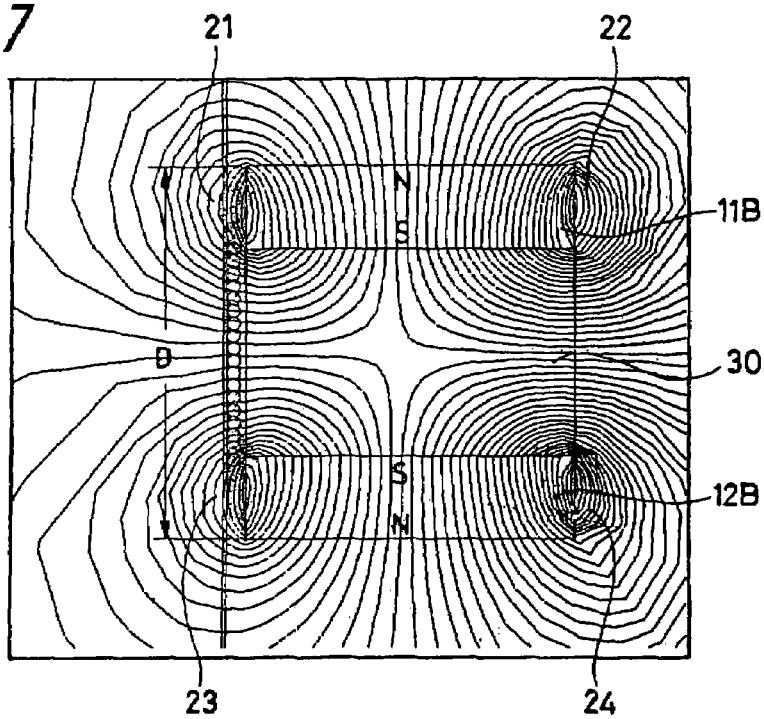
FIG. 7 (RELATED ART)
FIG. 7 is a magnetic-flux distribution map of a magnetic circuit in the conventional speakers explained in FIGS. 1 and 2.
Figure 8:
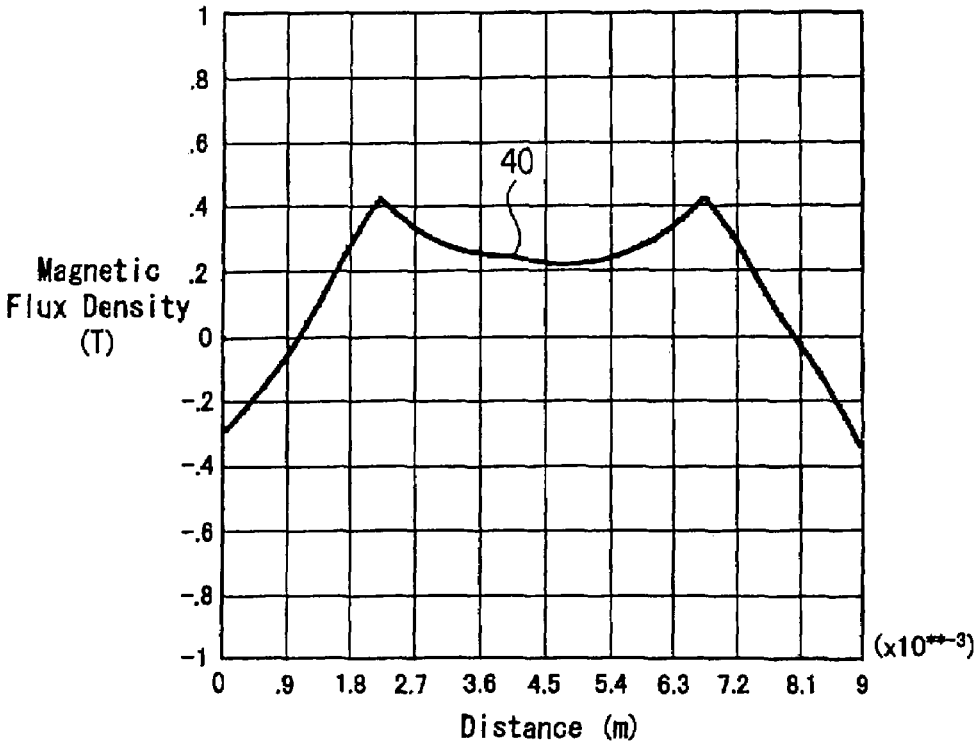
FIG. 8 (RELATED ART)
FIG. 8 is a graph showing a calculation result of the magnetic-flux distribution of a conventional magnetic circuit and speaker.

Hereinafter, embodiments of a magnetic circuit and speaker of the present invention is explained in detail with reference to FIGS. 3 to 6. FIG. 3 is a perspective and partly sectional view of a speaker according to an embodiment of the present invention; FIG. 4 is a magnetic-flux distribution map of a magnetic circuit shown in FIG. 3; FIG. 5 is a graph which shows a calculation result of the magnetic-flux distribution of a speaker and magnetic circuit according to an embodiment of the present invention; FIG. 6 is a perspective and partly sectional view of a speaker according to another embodiment of the present invention; FIG. 7 is a magnetic-flux distribution map of a magnetic circuit in the conventional speakers explained in FIGS. 1 and 2; and FIG. 8 is a graph which shows a calculation result of the magnetic-flux distribution of a conventional magnetic circuit and speaker.

Embodiment 1

An embodiment of the present invention is hereinafter explained based on the drawings. FIG. 3 is a perspective and partly sectional view of a speaker showing an embodiment of a speaker which has a symmetrical vibration system in the vibration direction, using a magnetic circuit of the three layered magnetic structure of the present invention. In FIG. 3, a numeral 10 denotes the whole of a speaker, which shows an example using a magnetic circuit, including magnets in the shape of a ring, which is symmetrical with respect to a center axis X-X of a voice coil 19 constituting the magnetic circuit. The first ring-shaped magnet 11 of the first layer and the third ring-shaped magnet 13 of the third layer are arranged in the directions to repel each other and are magnetized in the direction of thickness of the first magnet and third magnet such as N, S (S, N) and S, N (N, S). The second magnet 12 of the second layer is formed to be a ring-shaped magnet thicker than the first and third magnets 11 and 13 and is magnetized in the direction perpendicular to the magnetization direction of the first magnet 11 of the first layer and third magnet 13 of the third layer which are on top and bottom thereof, with the side of an inner diameter being a negative pole S and the side of an outer diameter being a positive pole N, for example.

Further, as shown in FIG. 3, with respect to the polarity of the magnets, a magnetic pole of the second magnet 12 of the second layer is magnetized such that the polarity on the side of a inner diameter becomes a negative pole S that is a reverse polarity to a positive pole N on the top side of the first magnet 11 of the first layer and a positive pole N of the bottom side of the third magnet 13 of the third layer, thereby obtaining a high magnetic flux density (large magnetic field) on the side of the inner diameter of the ring-shaped magnets.

The above described magnetization method is employed in the case where a speaker of an outer magnetic type is formed in which a magnetic circuit is arranged on the outer circumference side of a voice coil; and on the contrary, in the case where, for example, a speaker of an inner magnetic type is formed in which a magnetic circuit is arranged on the inner circumference side of a voice coil, in order to obtain a high magnetic flux density (large magnetic field) on the side of the outer diameter of a ring-shaped magnet, a magnetic pole of the second magnet 12 of the second layer is magnetized such that the polarity on the side of the outer diameter becomes a negative pole S that is a reverse polarity to a positive pole N on the top side of the first magnet 11 of the first layer and a positive pole N of the bottom side of the third magnet 13 of the third layer, thereby obtaining a high magnetic flux density (large magnetic field) on the side of the outer diameter of the ring-shaped magnet.

An outer circumference of an upper speaker edge 15 formed in the shape of a ring having upward convexity which supports an upper side diaphragm 14 is fixed by adhesive or the like close to an inner diameter on the upper surface side of the first magnet 11 of the first layer; and also, an outer circumference of a lower speaker edge 17 formed in the shape of a ring having downward convexity which supports a lower side diaphragm 16 is fixed by adhesive or the like close to an inner diameter on the lower surface side of the third magnet 13 of the third layer.

A voice coil bobbin 18 wound with a voice coil 19 is fixed by adhesive in the outer circumference of a center axis X-X of approximately a disk-shaped upper side diaphragm 14 and lower side diaphragm 16. The voice coil 18 is arranged to oppose the second magnet 12 of the second layer, and when the audio signal current flows in the voice coil 18, a driving force which drives the upper and lower side diaphragms is generated by the interaction between this current and the magnetic flux generated by the magnetic circuit.

At this time, when the upper and lower side diaphragms 14 and 16 and the upper and lower side speaker edges 15 and 17 are made into approximately the same shape, a symmetrical vibration system can be constructed in the vibration direction to obtain a speaker with the excellent sound quality.

In the above described embodiment, though explanation is made with respect to the upper and lower side circular diaphragms using a magnetic circuit formed of the first, second and the third magnets 11, 12, and 13 in the shape of a ring, it is needless to say a magnetic circuit may have other arbitrary frame shapes. Further, it is obvious that a disk shape can be employed in the case of an outer magnetic type.

FIG. 4 shows magnetic force lines of each leakage magnetic flux of Φ10, Φ11 of a magnetic circuit according to the present invention. The section of a magnetic circuit which is symmetrical with respect to a center axis X-X is shown. The magnetic circuit including ring-shaped first, second and third magnets 11A, 12A, and 13A of three layers are magnetized in the direction in which the first magnet 11A of the first layer repels the third magnet 13A of the third layer and are magnetized in the direction of the thickness. The second magnet 12A of the second layer is magnetized in the direction perpendicular to the magnetized direction of the first magnet 11A of the first layer and third magnet 13A of the third layer which are arranged at the top and bottom thereof.

Further, as the polarities of magnets 11, 12, and 13 shown in FIG. 3, a magnetic pole of the second magnet 12A of the second layer is magnetized such that the polarity of inner diameter side becomes opposite to the polarities of the upper surface of the first magnet 11A of the first layer and the bottom surface of third magnet 13A of the third layer.

The magnetic flux density distribution of each leakage magnetic flux of Φ10, Φ11 of a magnetic circuit of the above described construction is calculated in the following in comparison with that of a magnetic circuit of FIG. 7 which corresponds to the conventional magnetic circuit of FIG. 1.

The magnetic flux density distribution in FIG. 4 shows the case in which the values are calculated at the portion where a voice coil 18 is arranged, that is, the values are calculated by the finite element method at the position distant from the inner circumference of the first, second and third magnets 11A, 12A, 13A by 0.3 mm. The magnets used for the calculation are NEOMAX-32 (manufactured by Sumitomo Special Metals Co.), in which the first magnet 11A of the first layer and third magnet 13A of the third layer each have the inner diameter of 40 mm, the outer diameter of 56 mm and the thickness of 2 mm, and the second magnet 12A of the second layer has the inner diameter of 40 mm, the outer diameter of 56 mm and the thickness of 5 mm.

It can be understood that the magnetic force lines of each leakage magnetic flux of Φ10, Φ11 of the above described magnetic circuit converge at the inner circumference portion of the second magnet 12A of the second layer. The lines of magnetic force coming from the negative pole S on the inner diameter side of the second magnet 12A flows into the positive pole N side of the first and third magnets 11A and 13A, in which magnetic flux density distribution on the inner diameter side is high and the magnetic flux density distribution on the outer diameter side is low.

FIG. 5 shows, as a graph, a calculation result of magnetic flux density distribution of the leakage magnetic flux (Φ10, Φ11) in the above-mentioned magnetic circuit, and a horizontal axis shows the distance D on the side of the voice coil 18 of the first, second and third magnets 11A, 12A, and 13A, and a vertical axis shows the magnetic flux density, and it is also understood from this curve that the magnetic flux density in the vicinity of the first and third magnets 11A and 13A and the magnetic flux density of the second magnet 12A are large on the average.

Figure 1:
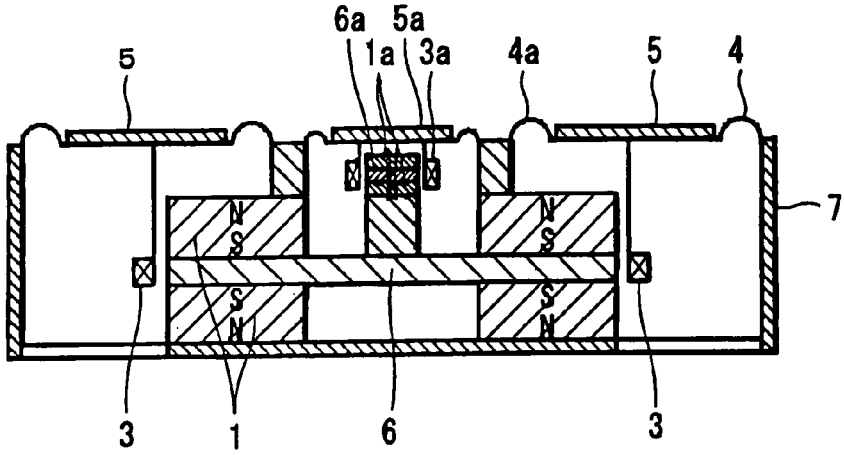
FIG. 1 (RELATED ART)
FIG. 1 is a vertically sectional view of a conventional speaker.

FIG. 7 shows a comparative example compared with the magnetic flux density distribution of the magnetic circuit of the present invention shown in FIG. 4, and FIG. 7 shows the lines of magnetic force of a magnetic circuit formed of conventional magnets having a repulsion magnetic field similar to FIG. 1. The magnetic circuit is shown in the section of a magnetic circuit that is symmetrical with respect to a center axis X-X and has three layers formed of two magnets and one ferromagnetic body. In this magnetic circuit, a first magnet 11B of the first layer and a third magnet 13B of the third layer are magnetized in the directions which repel each other and are magnetized in the direction of the thickness. The second layer is formed of a ring-shaped plate 30 made of a ferromagnetic material.

The magnetic flux density distribution of this case is calculated. The values are calculated by the finite element method at the position where a voice coil is arranged (distant from the inner circumference of magnets by 0.3 mm). The magnets used for the calculation are NEOMAX-32 (manufactured by Sumitomo Special Metals Co.), in which a ferromagnetic material is S15C, the first magnet 11B of the first layer and third magnet 13B of the third layer each have the inner diameter of 40 mm, the outer diameter of 56 mm and the thickness of 2 mm, and the ring-shaped plate 30 made of a ferromagnetic material of the second layer has the inner diameter of 40 mm, the outer diameter of 56 mm and the thickness of 5 mm.

The curve 40 of FIG. 8 shows a calculation result of the magnetic density distribution in the magnetic circuit with the magnets having the repulsion magnetic field of FIG. 7. The lines of magnetic force of the magnetic circuit show that the magnetic flux converges at both the inner and outer circumference portions of the ring-shaped plate 20 consisting of a ferromagnetic magnetic material of the second layer. In comparison with the magnetic circuit shown in FIG. 4 of the present invention, areas having strong magnetic flux appear in the portions in both the directions on the inner side and on the outside 21, 22, 23, and 24 in the magnetic circuit with the first and second magnets 11B and 13B of the conventional repulsion magnetic field, and since the magnetic flux in one direction 21, 23 or 22, 24 does not contribute to a driving force, the efficiency in use of the magnet deteriorates. In the case where each magnetic flux is used as the driving force, the structure becomes complicated due to the necessity of employing two voice coils and also a symmetrical vibration system in the vibration direction cannot obtain easily due to the necessity of providing a magnetic circuit inside a voice coil bobbin, which becomes problems. On the other hand, according to the present invention, since the area of strong magnetic flux appears only on the inner diameter side of the second magnet 12A of the second layer, the efficiency in use of the magnets becomes improved.

In the above described embodiment, though the lines of magnetic force are made to converge on the side of the inner diameter of the second magnets 12, 12A of the second layer, it can be made to converge on the outside of the outside diameter by placing the second magnets 12, 12A of the second layer with the polarity thereof in the opposite direction. Alternatively, the lines of magnetic force can be made to converge on the side of the outer diameter when the polarities of the first and third magnets 11, 11A, and 13, 13A of the first and third layers are reversed (11 and 13 are magnetized as S-N and N-S respectively, and the inner diameter side of 12 and the outer diameter side thereof are magnetized as S and N respectively).

Embodiment 2

FIG. 6 is a vertically sectional view showing a magnet circuit and speaker of another embodiment of the three layered magnet structure according to the present invention. In the embodiment shown in FIG. 6 a magnetic circuit in the shape of a ring that is symmetrical with respect to a center axis X-X is used. A first magnet 11C of the first layer and a third magnet 13C of the third layer are magnetized in the directions which repel each other and are magnetized in the direction of the thickness thereof. A second magnet 12C of the second layer is magnetized in the direction perpendicular to the magnetized direction of the first magnet 11C of the first layer and third magnet 13C of the third layer arranged at the top and bottom thereof.

Further, as shown in FIG. 6, the polarity on the side of the inner diameter of the second magnet 12C of the second layer is magnetized to become opposite to that of the upper surface of the first magnet 11C of the first layer and the bottom surface of the third magnet 13C of the third layer, so that the magnetic flux on the side of the inner diameter of a ring-shaped magnet becomes large.

An upper side speaker edge 15C which supports an upper side diaphragm 14C is fixed by adhesive on the upper surface of the first magnet 11C of the first layer, and also a lower side speaker edge 17C which supports a lower side diaphragm 16C is fixed by adhesive on the lower surface of the third magnet 13C of the third layer. A voice coil bobbin 18C vertically hanging and fixed between the outer circumference of the upper side diaphragm 14C and the outer circumference of the lower side diaphragm 16C by adhesive includes a voice coil 19CB wound on the outer circumference almost the center of a voice coil bobbin 18C and voice coils 19CA and 19CC wound in the opposite direction on both the ends of the voice coil bobbin 18C.

The voice coil 19CB is arranged to oppose the second magnet 12C of the second layer, and the voice coils 19CA and 19CC are arranged to oppose the first magnet 11C of the first layer and third magnet 13C of the third layer, respectively. Each of voice coils 19CA, 19CB, and 19CC is connected in series, and when the audio signal current flows into each of voice coils 19CA, 19CB, and 19CC, the driving force is generated in a vibration system by the interaction between this current and the magnetic flux which is generated in the magnetic circuit.

In the above described construction, since the strong magnetic field is generated in the portion of the second magnet 11C of the second layer and the magnetic field in the reverse direction occurs in the portions of the first magnet 11C of the first layer and of the third magnet 13C of the third layer as shown in the curve 25 of FIG. 5, the driving force of the same direction occur in each of voice coils 19CA, 19CB, and 19CC in the embodiment shown in FIG. 6.

According to the present invention, since the polarities of three sheets of magnets are used to construct a magnetic circuit, a thin and light-weight magnetic circuit and speaker can be obtained. Further, since a voice coil is wound almost at the center of the outer circumference of a voice coil bobbin to form a symmetrical vibration system connected on both ends of this voice coil, the high quality sound can also be obtained. Furthermore, the first, second and third coils are wound around the voice coil bobbin at the positions opposing respective magnets, and the winding direction of the first and third coils wound at the positions opposing to the first and third magnets of the first layer and third layer is reverse to the winding direction of the second coil wound at the position opposing to the second magnet of the second layer to form a voice coil. As a result, the second coil obtains a driving force from the second magnet of the second layer, and the first and third coils obtain a driving force from the portions in the vicinity of the first and third magnets of the first and third layers where the magnetic field in the reverse direction occurs, so that a sufficient driving force can be obtained with a thin and light-weight construction. Moreover, the inductance component of the input impedance of a speaker can be decreased to improve the high frequency characteristic. Further, no ferromagnetic substance having the magnetic flux density saturation characteristic is used as a component of the magnetic circuit, so that a magnetic circuit and speaker can be obtained in which the saturation phenomenon of the magnetic flux density does not occur even if a magnet having a considerably large magnetic energy is used.

The magnetic circuit of the present invention can be applied not only to a speaker but also to an electrokinetic type and electromagnetic type magnetic circuit of an electroacoustic transducer included in such devices as a headphone, earphone, hearing aid; to an electrokinetic type and electromagnetic type magnetic circuit of an acoustic-electrical transducer included in such devices as a microphone, transmitter, transmitter and receiver; and also to a rotor and stator of a electric motor, electric generator and so on. Further, although explanation has been made with respect to the case in which a magnet is ring-shaped, the shape of the magnet can be made into a frame having a polygonal outside shape and inner diameter.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A speaker, comprising:

a magnetic circuit which includes at least three layered magnets, wherein a first magnet of a first layer and a third magnet of a third layer are arranged in the magnetic directions which repel each other;

the direction of polarity of a second magnet of a second layer is arranged perpendicularly to the direction of polarity of said first magnet of the first layer and third magnet of the third layer;

a voice coil is wound around a center of a bobbin which is arranged to oppose an inner diameter of said second magnet of the second layer formed in a shape of a ring or a polygonal frame; and approximately the same vibration systems composed of a diaphragm and an edge are connected to both the top and bottom ends of said bobbin so that said vibration system that is symmetrical with respect to a center axis perpendicular to the direction of a center axis of said voice coil is provided.

2. The speaker according to claim 1, wherein the first, second and third magnets constituting said magnetic circuit are formed in the shape of a ring or a polygonal frame.

3. The speaker according to claim 1, wherein a winding direction of a second voice coil wound around said bobbin to oppose said second magnet of the second layer is made to be opposite to a winding direction of a first voice coil and a third voice coil wound around said bobbin to oppose said first magnet of the first layer and said third magnet of the third layer.

* * * * *